US005857347A

United States Patent [19]

Haugen et al.

[11] Patent Number: 5,857,347

[45] Date of Patent: Jan. 12, 1999

[54] REFRIGERATION SYSTEM AND A SEPARATOR THEREFOR

[75] Inventors: Ketil Haugen, Rydebäck; Håkan Ohlsson, Furulund; Per-Oskar Persson, Helsingborg, all of Sweden

[73] Assignee: Frigoscandia Equipment AB, Helsingborg, Sweden

[21] Appl. No.: 811,025

[22] Filed: Mar. 4, 1997

[51] Int. Cl.[6] ..... F25B 41/04; F25B 43/00

[52] U.S. Cl. ..... 62/204; 62/211; 62/220; 62/503

[58] Field of Search ..... 62/218, 219, 220–224, 62/211, 204, 503

[56] References Cited

U.S. PATENT DOCUMENTS 3,828,567 8/1974 Lesczynski ..... 62/220
5,435,149 7/1995 Strong et al. ..... 62/503

*Primary Examiner*—William Wayner
*Attorney, Agent, or Firm*—Browdy and Neimark

[57] ABSTRACT

A refrigeration system comprises a compressor, a condenser, a receiver and an evaporator, each having an inlet and an outlet, and a separator having an inlet and a first and a second outlet, connected to each other conventionally. The separator is positioned laterally of the evaporator and closer thereto than to the compressor. A controller ensures overfeed of the evaporator by regulating the feed rate of liquid refrigerant from the receiver such that the separator is feeding the evaporator with liquid refrigerant in proportion to demand and safeguarding the desired overfeed. The separator comprises a cylindrical container having two outlets and an inlet for separating the vapor and liquid components of a refrigerant. The inlet is directed tangentially into the cylindrical container. A foraminous partition is positioned inside the container and extends downwardly of the inlet and inwardly of the inner surface of the container for delimiting the central space and the peripheral space of the container from each other.

19 Claims, 2 Drawing Sheets

FIG.I

REFRIGERATION SYSTEM AND A SEPARATOR THEREFOR

BACKGROUND OF THE INVENTION

1. Field of the Invention

The present invention relates to a refrigeration system which comprises compressing means, condensing and receiving means and an evaporator, each having an inlet and an outlet; and a separator having an inlet and a first and a second outlet.

More particularly, the present invention is directed to a refrigeration system having an overfed evaporator, i.e. an evaporator that is fed with a liquid refrigerant in such a rate that the refrigerant is not totally evaporated at the outlet of the evaporator.

The invention also relates to a small volume separator for use in such a refrigeration system.

2. Background of the Invention

In such a conventional overfed refrigeration system, a large volume separator, often combined with a refrigerant pump, is used and is connected by long pipes with the evaporator for feeding the separated liquid refrigerant to the inlet of the evaporator and for receiving the liquid and vapor refrigerant from the outlet of the evaporator, one outlet of the separator being connected to the inlet of the compressing means for feeding the separated vapor refrigerant gas thereto. Therefore, the total volume of the refrigerant in the conventional system is large in comparison to the volume of the refrigerant maximally evaporated in the evaporator.

Also, the pressure losses are large in the conventional system which makes it difficult to attain as low a temperature as otherwise would be possible in the evaporator and requires the use of a higher capacity compressor. Further, a pump is normally necessary for transporting the liquid refrigerant to the evaporator which pump easily will be exposed to cavitation as a consequence of the low temperatures of the refrigerant and load fluctuations. Lowering these temperatures further would increase the risk of cavitation in the pump and also result in increased pressure losses in wet return suction lines.

SUMMARY OF THE INVENTION

One object of the present invention is to reduce the total volume of the refrigerant necessary in a refrigeration system using an overfed evaporator.

An other object of the invention is to reduce the pressure losses in such a refrigeration system and thereby increase the performance of the system.

These objects are attained by a refrigeration system which comprises compressing means, condensing and receiving means and an evaporator, each having an inlet and an outlet; and a separator having an inlet and a first and a second outlet;

wherein the first outlet of the separator is connected to the inlet of the evaporator, the outlet of the evaporator is connected to the inlet of the separator, the second outlet of the separator is connected to the inlet of the compressing means, the outlet of the compressing means is connected to the inlet of the condensing and receiving means, and the outlet of the condensing and receiving means is connected with the inlet of the separator;

wherein the separator is positioned substantially laterally of the evaporator and closer to the evaporator than to the compressing means; and wherein control means ensures overfeed of the evaporator by regulating the feed rate of liquid refrigerant to the separator from the condensing and receiving means such that the separator is feeding the evaporator with liquid refrigerant in proportion to demand and safeguarding the desired overfeed.

The control means preferably comprises a sensor for detecting the level of the liquid refrigerant in the separator, an expansion valve positioned in a line connecting the outlet of the condensing and receiving means with the inlet of the separator, and a control unit regulating the flow of liquid refrigerant through the expansion valve in response to the level detected by the sensor.

The control means could also comprise differential-temperature detecting means for detecting the temperature difference between the evaporator temperature and the temperature of the medium being cooled by the evaporator, on either side of the evaporator, or for detecting the temperature difference between the inlet temperature and the outlet temperature of the medium being cooled by the evaporator, and a control unit regulating the flow of liquid refrigerant, through the expansion valve described above, in response to the temperature difference detected by the differential-temperature detecting means.

A still other object of the invention is to eliminate the need for a pump for feeding the refrigerant to the evaporator.

This object is attained in that the control means during operation of the system is keeping the level of the liquid refrigerant in the separator between an upper limit positioned below the outlet of the evaporator and a lower limit positioned above the inlet of the evaporator.

Yet an other object of the invention is to provide a separator for substantially complete separation of the vapor and liquid components of the refrigerant ejected from the evaporator.

This object is attained by a separator which comprises a substantially cylindrical container having top and bottom outlets and an inlet thereinbetween for separating the vapor and liquid components of a refrigerant received from an evaporator in a refrigeration system, to said top and bottom outlets, respectively, said inlet being directed tangentially into the cylindrical container, wherein a foraminous, substantially cylindrical partition having a smaller width than the container, is positioned inside the container and extends downwardly of said inlet and inwardly of the inner surface of said container for delimiting the central space and the peripheral space of the container from each other.

Preferably, the separator is positioned in the space being cooled by the evaporator which, of course, will make more efficient use of the refrigerant.

Further, the refrigeration system may comprise a further control unit for regulating the level of the liquid refrigerant in the separator so as to be below an upper maximum limit which is positioned below or at the same level as the return line from the evaporator to the separator. Normally, this further control unit is only operative at starting-up of the refrigeration system and may be adapted to reduce the capacity of the compressor means and thereby lower the level of the liquid refrigerant in the separator below said upper maximum limit.

In a preferred embodiment, the outlet of the condensing and receiving means is connected to the inlet of the separator via a pipe connecting the outlet of the evaporator to the inlet of the separator, whereby the flow of liquid refrigerant from the condensing and receiving means supports the flow of vapor and liquid refrigerant out of the evaporator.

In order to obtain a completely efficient separation of the vapor and liquid components of the refrigerant ejected from the evaporator, the inlet to the separator may have a restriction for increasing the speed of flow of the refrigerant entering the separator.

In a preferred embodiment of the separator according to the invention, the foraminous, substantially cylindrical partition also extends above said inlet. The partition may comprise a net which comprises apertures having a size of 0.2–5.0 mm.

In short, the present invention uses the refrigerant with high efficiency by effectively separating the liquid component of the refrigerant exiting the evaporator. This results in the benefit of a dry return gas to the compressing means and a low refrigerant charge, i.e. the total volume of the refrigerant may be reduced drastically. In an exemplary plant, a typical volume reduction was 75%. Also, the dimensions of the system may be substantially reduced since no large volume separator is required any more.

Further, the refrigeration system according to the invention has a very high reliability because of the lack of refrigerant pumps in the preferred embodiment of the system.

DESCRIPTION OF THE PREFERRED EMBODIMENT

Figure 1:
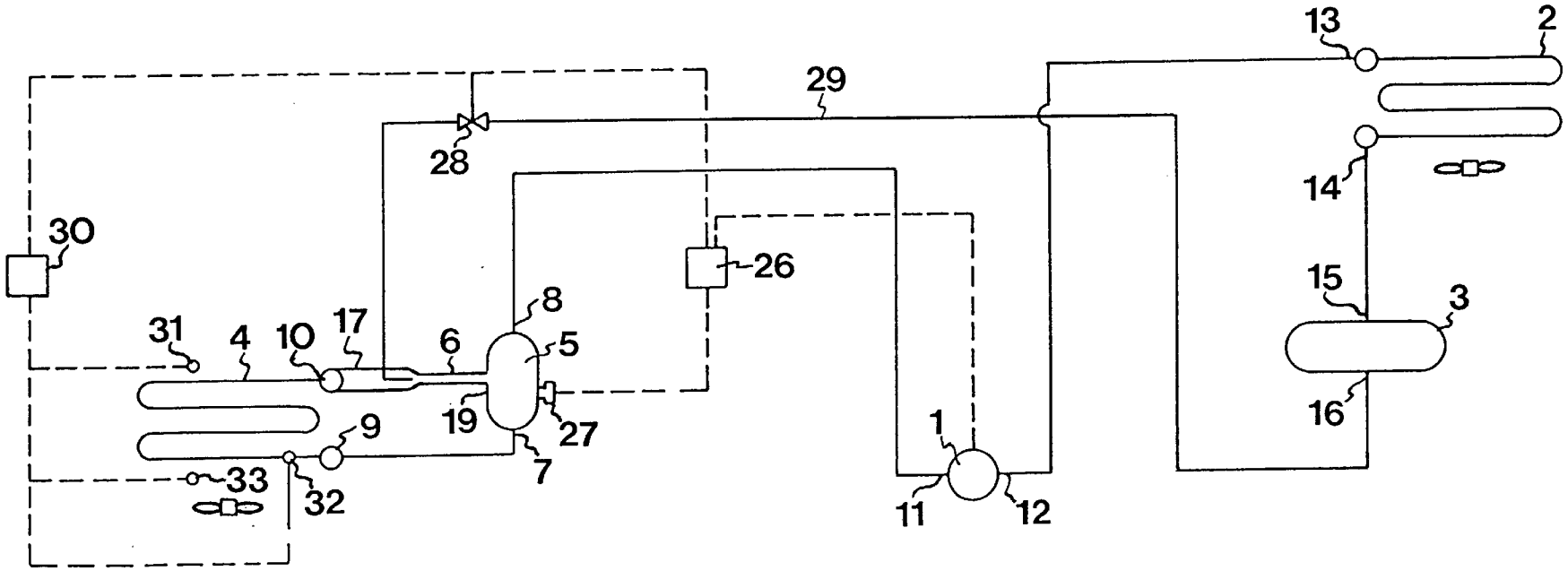
FIG. 1 schematically illustrates a refrigeration system according to a preferred embodiment of the present invention.

The refrigeration system illustrated in FIG. 1 comprises a compressor 1, a condenser 2, a receiver 3, and an evaporator 4, each having an inlet and an outlet. The refrigeration system further comprises a separator 5 having an inlet 6 and a first and a second outlet 7 and 8 respectively.

The first outlet 7 of the separator 5 is connected to the inlet 9 of the evaporator 4. The outlet 10 of the evaporator 4 is connected to the inlet 6 of the separator 5. The second outlet 8 of the separator 5 is connected to the inlet 11 of the compressor 1. The outlet 12 of the compressor 1 is connected to the inlet 13 of the condenser 2. The outlet 14 of the condenser 2 is connected to the inlet 15 of the receiver 3. Finally, the outlet 16 of the receiver 3 is connected to the inlet 6 of the separator 5 via a pipe 17 connecting the outlet 10 of the evaporator 4 with the inlet 6 of the separator 5.

Preferably, the separator 5 is positioned in a space which is cooled by the evaporator. This eliminates the need for insulating the separator 5.

Figure 2:
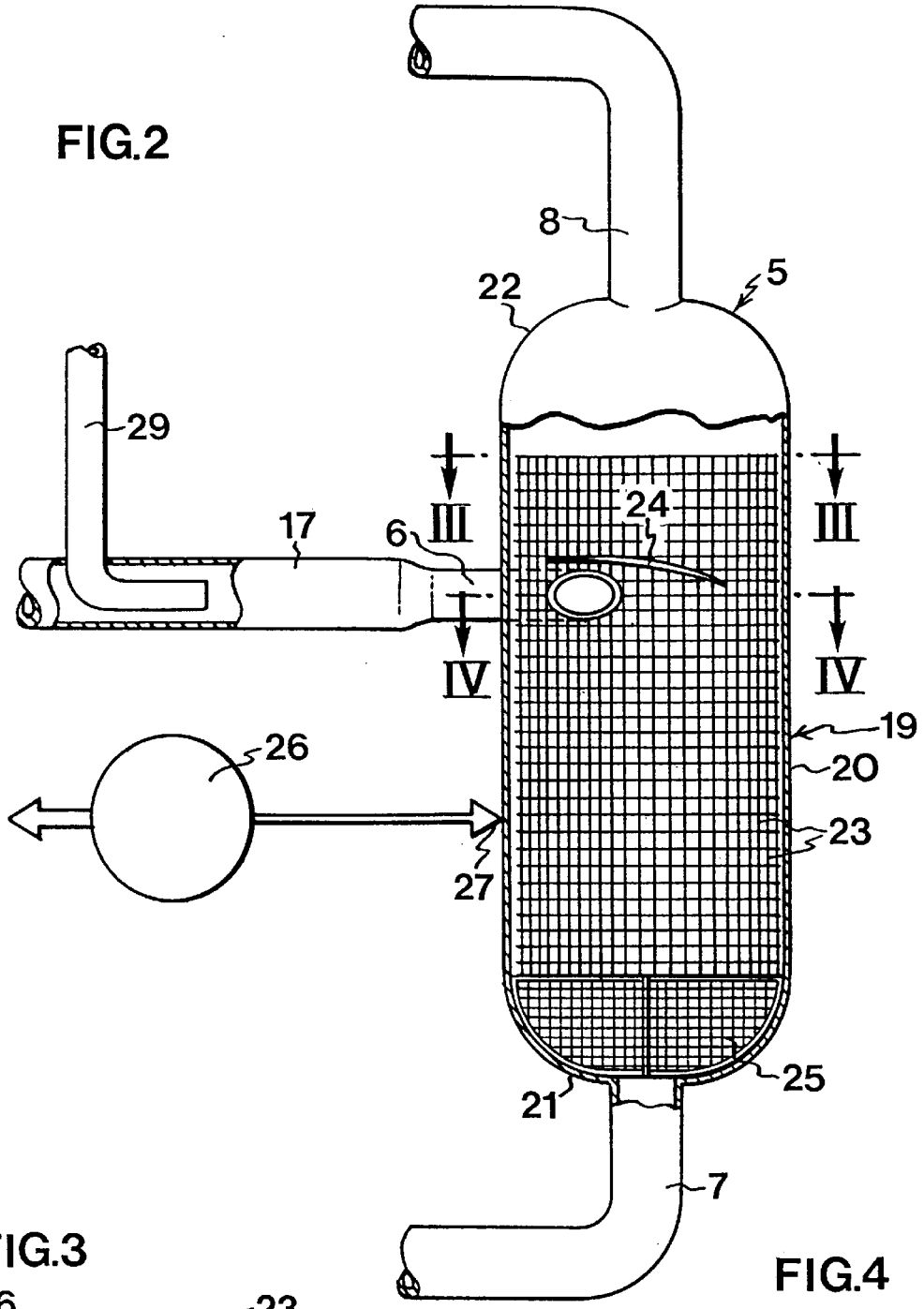
FIG. 2 is a cross-sectional view of a separator according to the present invention for use in a refrigeration system.
Figure 3:
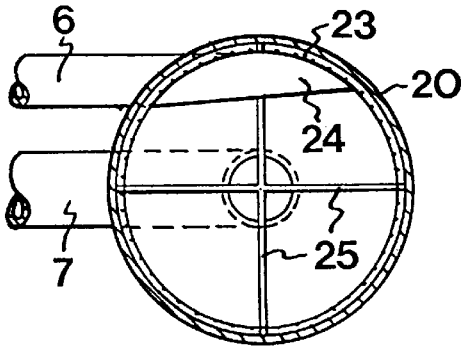
FIG. 3 is a cross-sectional view along lines III—III in FIG. 2.
Figure 4:
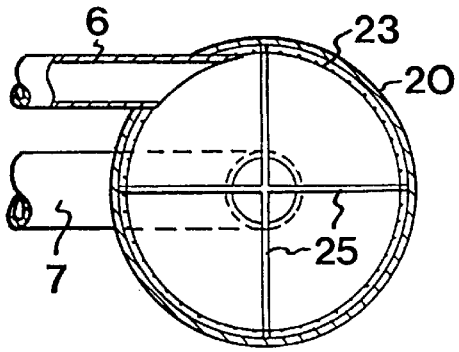
FIG. 4 is a cross-sectional view along lines IV—IV in FIG. 2.

The separator 5 illustrated in FIG. 2 comprises a container 19 formed as a substantially cylindrical shell 20 with rounded end caps 21 and 22. It has a first pipe forming the inlet 6 at a mid section, a second pipe forming the first outlet 7 in the bottom end cap 21, and a third pipe forming the second outlet 8 in the top end cap 22.

As evident from FIG. 1, the first inlet pipe 6 may be connected via pipe 17 to the outlet 10 of the evaporator 4 so as to receive the mixture of liquid and vapor refrigerant therefrom. Further, the inlet pipe 6 is directed tangentially into the container 19 such that the incoming mixture of liquid and vapor refrigerant will follow helical paths. Inside the cylindrical inner wall of the container 19, a foraminous partition 23 is provided, preferably a metallic net having a plurality of holes, openings or perforations. This foraminous partition 23 has a smaller width or diameter than the shell of the container 19 such that there is a small gap between the partition 23 and the inner surface of the container 19.

In operation, the mixture of the vapor and liquid components of the refrigerant received from the evaporator 4 is ejected into the separator 5 towards the inner side of the foraminous partition 23. The liquid component follows a spiral or helical path penetrating the foraminous partition 23. It then flows downwards in the gap between the inner surface of the container 19 and the foraminous partition 23. The vapor component of the refrigerant does not penetrate the foraminous partition 23 but forms a helical flow upwards in the container 19 and will be evacuated through the top outlet pipe. Hereby, a most efficient separation of the vapor and liquid components of the refrigerant outputted from the evaporator is possible.

Above the opening of the inlet pipe a splash shield 24 is mounted so as to prevent liquid drops from moving upwards instead of downwards in the separator 5.

Above the bottom outlet 7 of the container 19 and below the desired level of the liquid refrigerant therein, a vortex limiter 25 is provided so as to reduce the risk of introducing vapor refrigerant into the liquid refrigerant in the lower section of the container 19.

The refrigerant preferably is NH3 but other refrigerants such as freon substitutes may be used as well.

In operation, the mixture of liquid and vapor refrigerant from the evaporator 4 is thrown against the partition 23 with a certain minimum speed that gives the necessary centrifugal force to ensure the desired separation. The size of the openings in the partition 23, the viscosity of the liquid refrigerant and the distance between the partition 23 and the inner surface of the container 19 are other design criteria that influence the efficiency of the separation.

The result is that the liquid component of the refrigerant is dropping down in the gap between the inner surface of the container 19 and the partition 23 while the vapor component of the refrigerant will flow helically upwards through the center of the container 19. Any droplets entrained by this helical flow will be thrown by centrifugal force out towards that part of the partition 23 that is positioned above the inlet 6 to the separator 5 and thus be trapped by the partition 23 so as to flow down in the gap between the partition 23 and the inner surface of the container 19.

The vortex limiter 25, preferably having the form of a mesh cross, reduces vortex movement of incoming circulating liquid refrigerant and thereby simplifies the control of the level of the liquid refrigerant in the separator 5. Further, it is very important that a vortex is avoided at the bottom of the separator in order to ensure an even feed of liquid refrigerant to the evaporator, since a vortex could reduce the driving force and in extreme situations jeopardize the function of the evaporator.

The refrigeration system also comprises a control unit 26 receiving signals from a sensor 27 detecting the level of the liquid refrigerant in the container 19. The control unit 26 regulates that level to be between an upper limit positioned below the outlet of the evaporator and a lower limit positioned above the inlet of the evaporator. More precisely, the control unit 26 controls an expansion valve 28 in a pipe 29 connecting the outlet 16 of the receiver 3 with the inlet 6 of the separator 5 in response to the level detected by the level sensor 27, such that the level of the liquid refrigerant is kept between the lower and the upper limits under normal operation conditions.

A further control unit 30 which may be integrated in the control unit 26, may be used to ensure that the feed of fresh refrigerant liquid to the separator corresponds to the evaporated refrigerant liquid, and to prevent that too much refrigerant liquid is accumulated in the separator 5 during any load conditions.

This control unit 30 is connected to at least two of three temperature sensors 31–33 sensing the temperature of the medium being cooled by the evaporator 4 at the outlet side thereof, the temperature of the liquid refrigerant within the evaporator 4, and the temperature of the medium being cooled by the evaporator at the inlet thereof, respectively. More precisely, the sensors 31 and 33 are positioned in the flow of the medium being cooled, while the sensor 32 is positioned on the evaporator 4 itself, on the outlet or return pipe therefrom or within the evaporator 4 below the liquid level therein.

The control unit 30 detects the differential temperature of the sensors 31 and 32, 32 and 33, or 31 and 33, and controls the expansion valve 28 in the pipe 29 in such a way that the liquid flow is reduced at a decreasing differential temperature.

A still further control unit which may be integrated in the control unit 26 or can be a separate unit, may be used to keep the level of the liquid refrigerant in the separator 5 below a predetermined upper maximum limit by decreasing or increasing the capacity of the compressor 1, e.g. decreasing or increasing the rotational speed of the compressor 1. This maximum limit upper maximum limit is positioned below or at the same level as the Return line from the evaporator 4 to the separator 5. Normally, this further control unit is only operative at starting-up of the refrigeration system and may be adapted to reduce the capacity of the compressor 1. This results in a pressure increase in the separator 5 thereby lowering the level of the liquid refrigerant in the separator 5 below said upper maximum limit.

It should be noted that the feeding in of fresh refrigerant into the separator 5 is via the end of the pipe 29 opening within the pipe 17 towards the inlet 6 of the separator 5. Thereby, any vapor component of the fresh refrigerant will be separated in the same way as the vapor component of the mixture returned from the evaporator 4. The fresh refrigerant also helps the circulation between the evaporator 4 and the separator 5.

The above described and preferred embodiment may be modified in several ways.

As an example, the outlet of the condensing and receiving means could be connected directly to the separator via a further, separate inlet positioned above the liquid refrigerant level therein. The outlet of the condensing and receiving means could even be connected into the pipe leading from the first outlet of the separator to the inlet of the evaporator.

In FIG. 1, the condensing and receiving means constitutes a one-stage refrigeration system. However, a two-stage refrigeration system may also be used as is obvious to the man skilled in the art. Further, the condensing and receiving means may comprise a closed economizer or an open economizer. Thus, the structure of the compressing means as well as the condensing and receiving means may be varied within the scope of the invention.

Also, the evaporator may take several forms and be used for cooling different fluids, such as a gas, e.g. air, as well as a liquid. The cooled fluid may be used for freezing, e.g. in a food freezing plant, but also for cooling, e.g. in an air conditioning system.

It is therefore to be understood that the invention may be practiced otherwise than as specifically described,. within the scope of the appended claims.

What we claim is:

1. A refrigeration system comprising compressing means, condensing and receiving means, and an evaporator, each having an inlet and an outlet; and a separator having an inlet and a first and a second outlet;

wherein the first outlet of the separator is connected to the inlet of the evaporator, the outlet of the evaporator is connected to the inlet of the separator, the second outlet of the separator is connected to the inlet of the compressing means, the outlet of the compressing means is connected to the inlet of the condensing and receiving means, the outlet of the condensing and receiving means is connected with the inlet of the separator;

wherein the separator is positioned substantially laterally of the evaporator and closer to the evaporator than to the compressing means; and wherein control means ensures overfeed of the evaporator by regulating the feed rate of liquid refrigerant to the separator from the condensing and receiving means such that the separator is feeding the evaporator with liquid refrigerant in proportion to demand and safeguarding the desired overfeed.

2. A refrigeration system as claimed in claim 1, wherein the evaporator is fed with liquid refrigerant only.

3. A refrigeration system as claimed in claim 1, wherein the separator is positioned in the space being cooled by the evaporator.

4. A refrigeration system as claimed in claim 1, wherein the control means comprises a sensor for detecting the level of liquid refrigerant in the separator, an expansion valve positioned in a line connecting the outlet of the condensing and receiving means with the inlet of the separator, and a control unit regulating the flow of liquid refrigerant through the expansion valve in response to the level detected by the sensor.

5. A refrigeration system as claimed in claim 4, wherein the separator is feeding the evaporator with liquid refrigerant by gravity.

6. A refrigeration system as claimed in claim 4, comprising a further control unit for regulating the level of the liquid refrigerant in the separator so as to be below an upper maximum limit below the outlet of the evaporator.

7. A refrigeration system as claimed in claim 6, wherein the further control unit lowers the liquid refrigerant level in the separator by lowering the capacity of the compressor means.

8. A refrigeration system as claimed in claim 4, comprising a further control unit controlling the refrigerant liquid feed to the separator in response to the temperature difference between the evaporator and a medium being cooled thereby, or to the temperature difference of said medium being cooled at an inlet side and an outlet side of the evaporator.

9. A refrigeration system as claimed in claim 1, wherein the outlet of the condensing and receiving means is connected to the inlet of the separator via a pipe connecting the outlet of the evaporator to the inlet of the separator.

10. A refrigeration system as claimed in claim 1, wherein the inlet to the separator has a restriction in order to increase the speed of flow of the refrigerant entering the separator.

11. A refrigeration system as claimed in claim 10, wherein the separator comprises a substantially cylindrical container and the inlet is directed substantially tangentially into the cylindrical container.

12. A refrigeration system as claimed in claim 11, wherein a foraminous, substantially cylindrical partition having a smaller width than the container, is positioned inside the container and extends downwardly of said inlet and inwardly of the inner surface of said container.

13. A refrigeration system claimed in claim 12, wherein the foraminous, substantially cylindrical partition also extends above said inlet.

14. A refrigeration system as claimed in claim 12, wherein the partition comprises a net.

15. A refrigeration system as claimed in claim 12, further comprising a vortex limiter above the bottom outlet of the container.

16. A refrigeration system as claimed in claim 15, wherein the vortex limiter comprises at least one axially and radially extending, foraminous partition.

17. A refrigeration system comprising compressing means, condensing and receiving means, and an evaporator, each having an inlet and an outlet; and a separator having an inlet and a first and a second outlet;

wherein the first outlet of the separator is connected to the inlet of the evaporator, the outlet of the evaporator is connected to the inlet of the separator, the second outlet of the separator is connected to the inlet of the compressing means, the outlet of the compressing means is connected to the inlet of the condensing and receiving means, the outlet of the condensing and receiving means is connected with the inlet of the evaporator;

wherein the separator is positioned substantially laterally of the evaporator and closer to the evaporator than to the compressing means; and wherein control means ensures overfeed of the evaporator by regulating the feed rate of liquid refrigerant from the condensing and receiving means such that the separator is feeding the evaporator with liquid refrigerant in proportion to demand and safeguarding the desired overfeed.

18. A refrigeration system as claimed in claim 17, wherein the outlet of the condensing and receiving means is connected to a separate inlet to the separator above the liquid refrigerant level therein.

19. A refrigeration system as claimed in claim 17, wherein the outlet of the condensing and receiving means is connected into a pipe leading from the first outlet of the separator to the inlet of the evaporator.

* * * * *

UNITED STATES PATENT AND TRADEMARK OFFICE

CERTIFICATE OF CORRECTION

PATENT NO. : 5,857,347

DATED : Jan. 12, 1999

INVENTOR(S) : Ketil Haugen, et al.

It is certified that error appears in the above-identified patent and that said Letters Patent is hereby corrected as shown below:

Please insert the following in the claims:

20. A refrigeration system as claimed in claim 12, wherein the foraminous partition comprises apertures having a size of 0.2-5.0 mm.

On the title page under Abstract "19 claims" should read --20 claims --

UNITED STATES PATENT AND TRADEMARK OFFICE

CERTIFICATE OF CORRECTION

PATENT NO. : 5,857,347

DATED : Jan. 12, 1999

INVENTOR(S) : Ketil Haugen, et al.

It is certified that error appears in the above-identified patent and that said Letters Patent is hereby corrected as shown below:

Please insert the following on the front page of the patent:

References Cited

U. S. PATENT DOCUMENTS

| | | | |
|---|---|---|---|
| 2,099,085 | 11/1937 | SHRODE | 62/83 |
| 2,570,962 | 10/51 | McBROOM | 62/503 |

FOREIGN PATENT DOCUMENTS

| | | |
|---|---|---|
| 95/30117 | 10/1995 | WORLD ORIGIN |

Signed and Sealed this

Sixteenth Day of November, 1999

*Attest:*

*Attesting Officer*

Q. TODD DICKINSON

*Acting Commissioner of Patents and Trademarks*